United States Patent [19]

Houck

[11] 4,390,368

[45] Jun. 28, 1983

[54] FLAME SPRAY POWDER

[75] Inventor: David L. Houck, Towanda, Pa.

[73] Assignee: GTE Products Corporation, Stamford, Conn.

[21] Appl. No.: 250,323

[22] Filed: Apr. 1, 1981

[51] Int. Cl.[3] ..... B22F 1/00

[52] U.S. Cl. ..... 75/251; 75/0.5 BB; 420/433

[58] Field of Search ..... 75/0.5 B, 0.5 BB, 0.5 BC, 75/0.5 C, 251–255; 420/433; 427/34, 423

[56] References Cited

U.S. PATENT DOCUMENTS

| | | | |
|---|---|---|---|
| 3,236,699 | 2/1966 | Pugh et al. | 75/0.5 BB |
| 3,341,320 | 9/1967 | Smiley | 75/0.5 BB |
| 3,475,158 | 10/1969 | Neunschwander | 75/0.5 BB |
| 3,623,860 | 11/1971 | Cheney et al. | 75/0.5 AB |

*Primary Examiner*—Michael L. Lewis

*Attorney, Agent, or Firm*—R. E. Walter

[57] ABSTRACT

A free flowing plasma spray powder of substantially spherical particles having substantially smooth surfaces and of uniform composition consisting essentially of about 4 to about 6 percent by weight rhenium with the balance being tungsten.

3 Claims, No Drawings

FLAME SPRAY POWDER

BACKGROUND OF INVENTION

This invention relates to a free flowing powder for flame spray applications.

Free flowing powders for flame spraying have been made by various agglomeration methods which make free flowing powders of normally non-flowing small diameter particles. One such agglomeration method is spray drying. Agglomerates are formed in spray drying by atomizing a slurry of powder, binder and liquid into a drying chamber where the liquid is evaporated. The result is a generally spherical agglomerate held together by the binder. U.S. Pat. No. 3,617,358 describes an agglomeration process using an organic binder.

Other agglomeration processes have been developed to overcome what may be undesirable effects caused by the presence of organic binders. In some cases, the organic binder may cause fouling of the plasma gun due to vaporization of the organic. The presence of organics may even decrease the apparent density of the powder or affect the flame spray coating. In U.S. Pat. No. 3,881,911 to Cheney et al., the agglomerates are presintered to remove the binder. U.S. Pat. No. 3,973,948 to Laferty et al. uses a water soluble ammonia complex as a binder and U.S. Pat. No. 4,025,334 to Cheney et al. uses an aqueous nitrate solution.

Because of their relatively large size and low surface area as compared with the original small particles which are often irregular in shape, the agglomerates have improved flow properties. However, the increased particles size and lower density resulting from agglomeration can be a disadvantage. Hence, plasma densification may be employed to produce spherical, dense, and homogeneous particles. According to this process, the agglomerated powder is entrained in a carrier gas, and fed through a high temperature plasma reactor to melt the agglomerated particles. The melted particles are cooled to avoid coalesence so as to produce spherical dense particles. The use of the dense particle in plasma spray applications can result in a dense, smooth coating which requires little or no finishing by grinding or machining as compared to coatings produced by the agglomerated particles. Further, the densified particles have improved flow characteristics and enable the use of a reduced volume of material and decreased processing time to achieve improved efficiencies in flame spraying. U.S. Pat. Nos. 3,909,241 and 3,974,245, both to Cheney et al., relate to such densification processes and the powders produced therefrom.

SUMMARY OF THE INVENTION

In the production of X-ray tubes, tungsten-rhenium coatings are applied to the target. Historically, these coatings have been applied by either a physical vapor deposition or a chemical vapor deposition process. This invention relates to a powder that can be used for the plasma coating of X-ray targets.

In accordance with the present invention, there is provided a free flowing plasma spray powder of substantially spherical particles having substantially smooth surfaces, said powder being a substantially uniform composition consisting essentially of about 4 to about 6 percent by weight rhenium with the balance being tungsten.

DETAILED DESCRIPTION

The plasma spray powder of the present invention consist essentially of about 4 to about 6 percent by weight rhenium with balance tungsten. Preferably the rhenium content is about 5 percent by weight based on the total weight of the powder. Due to the method of preparing the plasma spray powder of the present invention, the powder particles are fine, sperical and dense. Although the individual particles may have compositions that vary from particle to particle, the overall composition of the powder is substantially uniform. The plasma densification of the particles preferably results in a prealloying of individual particles to produce substantially homogeneous composite particles.

Preferably the plasma spray powder has a particle size distribution wherein substantialy none of the particles have a size less than 10 microns. Substantially all the particles pass through a 325 U.S. screen mesh. The bulk density is from about 10 to about 11 grams/cc. Preferably the Hall flow is within the range of from about 4 to 7 seconds for 50 grams.

The above particle measurements were performed with a Micromerograph. Using projection methods and photography measurements counting in selected size ranges may be employed up to the finest particle sizes. The above distribution of particles will appear different depending on the type of measurement technique employed. For instance, a Roller analyzer might give a broader range in particle sizes. In using a Roller analyzer (American Instrument Co.), particles are separated into closely sized fractions by carrying them upward in a controlled stream of air. Those particles too small to settle against the upward velocity are removed from the air stream for weighing in a paper filter. Another method of measuring particle size, referred to as the Fisher Sub-Sieve Size which uses air-permeability and is based on the relation between specific surfaces of packed particles and their permeability. The air-permeability method gives only air average particle size, not a particle size-ditribution. The Sub Sieve Sizer apparatus is available commercially from Fisher Scientific Co.

In preparing the flame spray powder of the present invention, a powder blend consiting essentially of pure rhenium and pure tungsten are mixed by methods known in the art, such as by a blender, tumbler or even by milling to obtain suitable particle sizes if size reduction is desired. Preferably the overall powder blend has an average particle size less than about 10 microns.

The uniform powder blend is next agglomerated by methods known in the art. Such agglomeration techniques may be by forming powder compacts followed by crushing these compacts or mixing the powder with a binder in the presence of moisture. Agglomeration by spray drying is in general preferred for its flexibility and economy of operation on a production scale. Conditions under which slurries are formed and spray dried are well known. U.S. Pat. No. 3,617,358, issued Nov. 2, 1971 describes formation of slurries. Other suitable methods for agglomerating are described in U.S. Pat. Nos. 3,881,911; 3,973,948 and 4,025,734, hereinafter discussed. The agglomeration technique results in a uniform mixture of ingredients. Preferably the agglomeration procedure entails the mixing of the ultrafine powder mixture with a binder such as carbowax 6000 or polyvinyl alcohol, for example Monsanto Gel Vatol 20–30. The resulting agglomerates are free flowing as compared to the starting components.

The agglomerates may be conveniently classified to obtain a desired particle size distribution, preferably at least about 80% of the particles within about a 50 micron particle size range. The agglomerated particles may be sintered to stabilize the agglomerate.

The agglomerated particles are plasma densified so as to produce fine, spherical, densified particles. The densification process comprises entraining agglomerated powders in a carrier gas and feeding the entrained particles through a high temperature reactor. The particles pass through the reactor at such a flow rate that interparticle contact and coalescence are avoided but that at least the outer surfaces of the particles are melted. After melting, the particles fall through a distance sufficient to permit solidification and cooling prior to contact with a solid surface or each other.

Because the particles are melted while entrained in a carrier gas, the solidified particles are substantially spherical, have smooth surfaces and thus excellent flowability. The powders of the present invention exhibit apparent densities of 40% or more of the theoretical density of the given material. In addition, the solidified particles have the same general size range as the starting material, but, depending on the porosity of the starting material, may have a smaller mean particle size, due to densification during melting. Preferably the melting during densification is to such an extent that each particle is prealloyed to a homogeneous composition.

The plasma densification is preferably carried out in a plasma flame reactor. Details of the principles and operation of such plasma flame reactors are well known. Commercially available plasma flame spray reactors are equipped with powder feeders. The reaction zone temperature is at least preferably above the melting point of the highest melting component and preferably above the vaporization point of the lowest vaporizing component of the material to enable a relatively short residence time in the reaction zone. By way of example, typical plasma spray reactors have temperature capabilities between 10,000° F. and 30,000° F. enabling powder feed rates from ½ up to 30 pounds per hour.

The melted particles must be cooled at a rate sufficient to solidify at least an outer layer of the particles prior to their contact with a solid surface or with each other in order to maintain their sphericity and particle integrity. While any of several methods may be used to achieve this result, it has been found convenient to feed the melted particles while still entrained in the carrier gas into a liquid cooled chamber containing a gaseous atmosphere. The chamber may conveniently serve as a collection vessel. The size distribution of the starting material is substantially retained while the mean particle size may be up to 50% smaller.

The resulting powder is next passed through a hydrogen reduction furnace to reduce the oxygen level. Such a furnace has a hydrogen atmosphere is at a temperature in excess of 500° C. The final powder preferably has less than about 1000 parts per million impurities based on the total weight of the powder. Preferably nitrogen, carbon and oxygen are each at impurity levels less than about 100 parts per million.

EXAMPLE

A flame spray powder is prepared by blending rhenium and tungsten powders in amounts sufficient to result in a blend comprising a total of 5% rhenium with the remainder being tungsten. A slurry is prepared by combining the resulting powder blend with paraffin wax and stearic acid in the relationship of 97.6:2:0.4, respectively, with enough trichloroethane to make an 80–85% solids concentration. Spray drying is carried out by pumping the slurry at low pressure through a fluid nozzle located at the top of a commercially available spray dryer. The slurry is continually agitated throughout the spray drying run. The atomization air pressure to the nozzle is 40–60 psi. The inlet air temperature is 370°–430° C. with an outlet temperature of 140°–150° C. The spray dried powder is fired for approximately 7 hours at 1000° C. to remove organic binders and to strengthen the agglomerate particles. The sintered agglomerates are sifted using a standard 325 mesh U.S. screen. The resulting −325 particles are fed through a commercially available plasma torch into a water cooled collection tank. A mixture of 126 cubic feet per hour of argon and 70 cubic feet per hour of hydrogen is fed to the plasma torch. The torch power is about 28 KVA. Nitrogen gas is fed to a powder feeder at the rate of 7 cubic feet per hour to entrain the powder which passes through the torch. The cooled powder is next placed in open boats in a hydrogen reduction furnace which is at a temperature of 500° C. for about 2 hours. The final particles have the following composition: rhenium 4.6%, carbon less than 5 ppm, oxygen about 70 ppm, and the balance tungsten. The powder was classified to give a powder wherein 100 percent passes through a 325 mesh and substantially all the particles have a size greater than about 10 microns. The bulk density is 10.6 g/cc and the Hall Flow is 6 sec./150 g.

I claim:

1. A free flowing plasma spray powder of substantially spherical particles having substantially smooth surfaces, said powder having a Hall flow within the range of about 4 to about 7 seconds for about 50 grams and being substantially uniform composition consisting essentially of about 4 to about 6 percent by weight rhenium with the balance being tungsten, wherein substantially all of said particles have a size greater than about 10 microns and are melt alloyed by plasma densification to a uniform composition.

2. A free flowing plasma spray powder according to claim 1 wherein the powder contains less than 1000 parts per million impurities based on the weight of powder.

3. A free flowing plasma spray powder according to claim 2 wherein the powder is less than about 325 mesh size.

* * * * *